US008781350B2

(12) United States Patent
Kondo et al.

(10) Patent No.: US 8,781,350 B2
(45) **Date of Patent: *Jul. 15, 2014**

(54) IMAGE FORMING APPARATUS

(75) Inventors: Kunihiko Kondo, Handa (JP); Kengo Yada, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 135 days.

This patent is subject to a terminal disclaimer.

(21) Appl. No.: 13/303,733

(22) Filed: Nov. 23, 2011

(65) Prior Publication Data

US 2012/0128382 A1 May 24, 2012

(30) Foreign Application Priority Data

Nov. 24, 2010 (JP) ..... 2010-261677
Nov. 24, 2010 (JP) ..... 2010-261680

(51) Int. Cl.
*G03G 15/02* (2006.01)

(52) U.S. Cl.
USPC ..... 399/50; 399/89; 399/171

(58) Field of Classification Search
USPC ..... 399/50, 89, 100, 168, 170, 171
See application file for complete search history.

(56) References Cited

U.S. PATENT DOCUMENTS

| | | | | |
|---|---|---|---|---|
| 6,553,192 | B2 * | 4/2003 | Maebashi | 399/50 |
| 2001/0043817 | A1 | 11/2001 | Maebashi | |
| 2007/0086801 | A1 * | 4/2007 | Sakato et al. | 399/50 |
| 2008/0050143 | A1 | 2/2008 | Barry | |
| 2008/0050144 | A1 | 2/2008 | Hashimoto | |
| 2008/0226313 | A1 | 9/2008 | Tsuchida et al. | |
| 2010/0080592 | A1 | 4/2010 | Hamaya et al. | |
| 2010/0080593 | A1 | 4/2010 | Inukai et al. | |
| 2012/0027436 | A1 * | 2/2012 | Maruyama et al. | 399/31 |

FOREIGN PATENT DOCUMENTS

| | | | | |
|---|---|---|---|---|
| JP | 63178259 | A * | 7/1988 | G03G 15/00 |
| JP | H03-089264 | A | 4/1991 | |
| JP | H03-142483 | A | 6/1991 | |
| JP | H09-109512 | A | 4/1997 | |
| JP | 2001-066842 | A | 3/2001 | |
| JP | 2001-324850 | A | 11/2001 | |
| JP | 2002-333811 | A | 11/2002 | |

(Continued)

OTHER PUBLICATIONS

Japan Patent Office, Notification of Reason for Refusal in counterpart Patent Application No. JP 2010-261677 (dispatch date Mar. 12, 2013).

(Continued)

*Primary Examiner* — David Gray
*Assistant Examiner* — Carla Therrien
(74) *Attorney, Agent, or Firm* — Baker Botts L.L.P.

(57) ABSTRACT

An image forming apparatus includes: a first photosensitive member; a second photosensitive member; a third photosensitive member; a first scorotron-type charger that is configured to charge the first photosensitive member; a second scorotron-type charger that is configured to charge the second photosensitive member; a third scorotron-type charger that is configured to charge the third photosensitive member; a first voltage applying circuit, which is connected to the first scorotron-type charger, and which is configured to apply a voltage to the first scorotron-type charger; and a second voltage applying circuit, which is commonly connected to the second scorotron-type charger and the third scorotron-type charger, and which is configured to apply a voltage to the second scorotron-type charger and the third scorotron-type charger.

8 Claims, 7 Drawing Sheets

(56) References Cited

FOREIGN PATENT DOCUMENTS

| | | | |
|---|---|---|---|
| JP | 2007-086117 | A | 4/2007 |
| JP | 2008-052215 | A | 3/2008 |
| JP | 2008-224955 | A | 9/2008 |
| JP | 2009-294480 | A | 12/2009 |
| JP | 2010-044205 | A | 2/2010 |
| JP | 2010-079045 | A | 4/2010 |
| JP | 2010-096837 | A | 4/2010 |

OTHER PUBLICATIONS

Japan Patent Office, Notification of Reason for Refusal in counterpart Patent Application No. JP 2010-261680 (dispatch date Jan. 22, 2013).

European Patent Office, extended European Search Report for European Patent Application No. 11189965.4 (counterpart to above-captioned patent application), dated Mar. 15, 2012.

* cited by examiner

IMAGE FORMING APPARATUS

CROSS-REFERENCE TO RELATED APPLICATIONS

This application claims priority from Japanese Patent Application No. 2010-261677 filed on Nov. 24, 2010 and Japanese Patent Application No. 2010-261680 filed on Nov. 24, 2010, the entire subject matter of which is incorporated herein by reference.

TECHNICAL FIELD

The invention relates to an image forming apparatus that is configured to perform a black-white printing and a color printing.

BACKGROUND

There has been proposed a related-art image forming apparatus such as color printer and the like including photosensitive members and scorotron-type chargers for charging the photosensitive members in correspondence to developers of respective colors. In the related-art image forming apparatus, one common voltage applying circuit that applies a voltage to the respective scorotron-type chargers is used to reduce the cost and to reduce a size of the apparatus.

SUMMARY

However, according to the above-described related-art image forming apparatus, since the voltage applying circuit is made to be common, it is not possible to adjust the voltage that is applied to each scorotron-type charger. In the meantime, the scorotron-type charger for black is frequently used, so that foreign substances are apt to be attached to a wire of the scorotron-type charger for black, compared to other scorotron-type chargers. Thus, a large difference occurs in discharge amounts of the scorotron-type charger for black and the other scorotron-type chargers, so that an image quality is degraded.

Further, the foreign substances are little attached to the wire of the scorotron-type charger arranged near an exhaust fan of an apparatus body, compared to other scorotron-type chargers, so that a large difference occurs in discharge amounts thereof and the image quality is degraded.

Therefore, illustrative aspects of the invention provide an image forming apparatus capable of reducing a difference of discharge amounts caused due to a difference of contamination degrees of respective scorotron-type chargers.

According to one illustrative aspect of the invention, there is provided an image forming apparatus comprising: a first photosensitive member; a second photosensitive member; a third photosensitive member; a first scorotron-type charger that is configured to charge the first photosensitive member; a second scorotron-type charger that is configured to charge the second photosensitive member; a third scorotron-type charger that is configured to charge the third photosensitive member; a first voltage applying circuit, which is connected to the first scorotron-type charger, and which is configured to apply a voltage to the first scorotron-type charger; and a second voltage applying circuit, which is commonly connected to the second scorotron-type charger and the third scorotron-type charger, and which is configured to apply a voltage to the second scorotron-type charger and the third scorotron-type charger.

According to another illustrative aspect of the invention, the first photosensitive member corresponds to black developer, and the second photosensitive member and the third photosensitive member correspond to developers other than black.

According to still another illustrative aspect of the invention, the image forming apparatus further comprises a fan that is configured to exhaust air in the image forming apparatus to an outside, wherein the first photosensitive member is arranged more closely to the fan than the second photosensitive member and the third photosensitive member.

According to the illustrative aspects of the invention, the voltage applying circuits are separately provided to the first scorotron-type charger that is apt to be contaminated and other scorotron-type chargers. Thus, it is possible to reduce the difference of the discharge amounts, which is caused due to the difference of contamination degrees of the wires of the respective scorotron-type chargers.

According to the illustrative aspects of the invention, the voltage applying circuit for applying the voltage to the chargers is separated into the voltage applying circuit, which is connected to the scorotron-type charger that is frequently used and the wire thereof is apt to be contaminated, and the voltage applying circuit, which is commonly connected to other scorotron-type chargers having the wires that are little contaminated. Accordingly, it is possible to reduce the difference of the discharge amounts, which is caused due to the difference of contamination degrees of the wires of the respective scorotron-type chargers.

DETAILED DESCRIPTION

First Exemplary Embodiment

Hereinafter, a first exemplary embodiment of the invention will be specifically described with reference to the drawings. In the following descriptions, an overall configuration of an image forming apparatus 1 will be briefly described and then the characteristics of the invention will be described in detail. Incidentally, a color printer is one example of the image forming apparatus 1.

Further, in the following descriptions, the directions are described on the basis of a user who uses the image forming apparatus 1.

Figure 1:
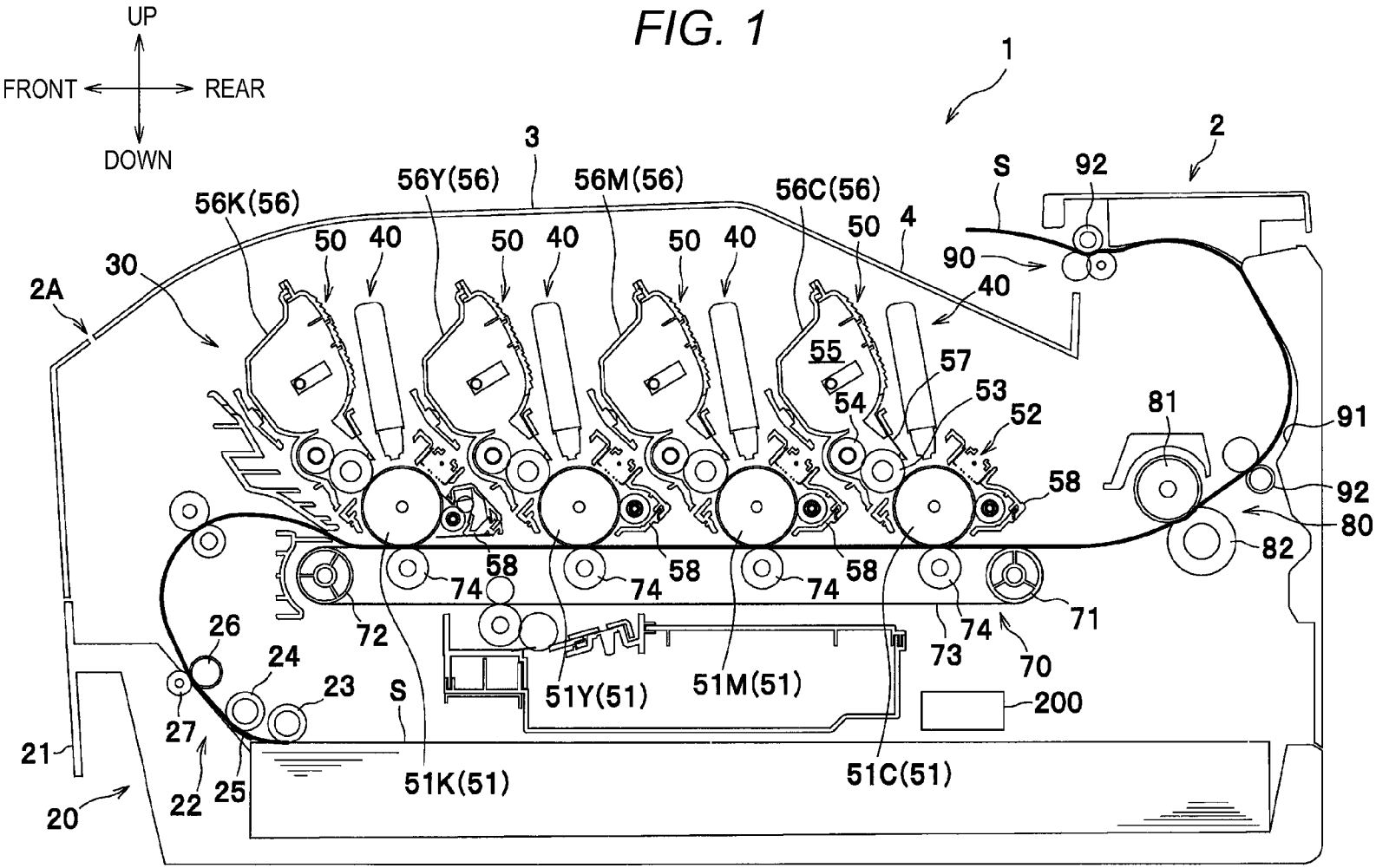
FIG. 1 is a side sectional view showing an image forming apparatus according to a first exemplary embodiment of the invention.

In other words, in FIG. 1, the left side is referred to as the 'front side', the right side is referred to as the 'rear (inner) side', the inner side of a direction perpendicular to the sheet is referred to as the 'left side' and the front side of the direction perpendicular to the sheet is referred to as the 'right side.' Also, the upper-lower direction of the sheet is referred to as the 'upper-lower' direction.

(Overall Configuration of Image Forming Apparatus)

As shown in FIG. 1, the image forming apparatus 1 includes, in an apparatus body 10, a feeder unit 20 that feeds a sheet S (recording sheet (transfer medium)), an image forming unit 30 that forms an image on the fed sheet S and a sheet discharge unit 90 that discharges the sheet S on which the image is formed.

An opening 2A is formed at an upper part of the apparatus body 2. The opening 2A is opened and closed by an upper cover 3 that is rotatably supported to the apparatus body 2. An upper surface of the upper cover 2 configures a sheet discharge tray 4, on which the sheets S discharged from the apparatus body 2 are accumulated.

The feeder unit 20 is provided at a lower part in the apparatus body 2. The feeder unit 20 includes a feeder tray 21 that is detachably mounted to the apparatus body 2 and a sheet feeding mechanism 22 that conveys the sheet S from the feeder tray 21 to the image forming unit 30. The sheet feeding mechanism 22 is provided at the front side of the feeder tray 21. The sheet feeding mechanism 22 includes a feeder roller 23, a separation roller 24 and a separation pad 25.

In the feeder unit 20 configured as described above, the sheets S in the feeder tray 21 are separated one at a time and sent upwardly. While the sheet passes between a paper dust removing roller 26 and a pinch roller 27, the paper dusts are removed. Then, the sheet S passes to a conveyance path (not shown), is turned over to convert the direction thereof and then supplied to the image forming unit 30.

The image forming unit 30 includes four LED units 40, four developing units 50, a transfer unit 70, a fixing unit 80 and a power supply device 200.

The LED unit 40 is swingably connected to an LED attachment member (not shown) that is provided at the lower part of the upper cover 3. The LED unit 40 is appropriately positioned by a positioning member provided to the apparatus body 2.

The developing units 50 are arranged in parallel with each other in the front-rear direction between the upper cover 3 and the feeder unit 20. Each of the developing units 50 includes a drum cartridge 58 and a developing cartridge 56 that is detachably mounted to the drum cartridge 58.

The developing cartridge 56 mainly includes a developing roller 53, a supply roller 54, a layer thickness regulation blade 57 and a toner accommodation chamber 55 that accommodates toner (one example of developer).

Also, the developing cartridges 56K, 56Y, 56M, 56C in which color toners for black, yellow, magenta and cyan are respectively accommodated are arranged side by side in the corresponding order from the upstream side of a conveyance direction of the sheet S.

The drum cartridge 58 has a photosensitive drum 51 (one example of a photosensitive member), a scorotron-type charger 52 and the like. In the specification and the drawings, when specifying the photosensitive drums 51 and the scorotron-type chargers 52 corresponding to colors of toner, the reference numerals K, Y, M and C are attached in correspondence to black, yellow, magenta and cyan.

In the first exemplary embodiment, the photosensitive drum 51K corresponding to black toner is referred to as 'first photosensitive drum 51K' (first photosensitive member). The photosensitive drums 51Y, 51M, 51C corresponding to the toner of respective colors except for black are referred to as 'second and third photosensitive drums 51Y, 51M, 51C' (second and third photosensitive members). In addition, the scorotron-type charger 52K for black, which charges the first photosensitive drum 51K, is referred to as 'first scorotron-type charger 52K', and the scorotron-type chargers 52Y, 52M, 52C except for black, which charge the second and third photosensitive drums 51Y, 51M, 51C, are referred to as 'second and third scorotron-type chargers 52Y, 52M, 52C.'

Figure 2:
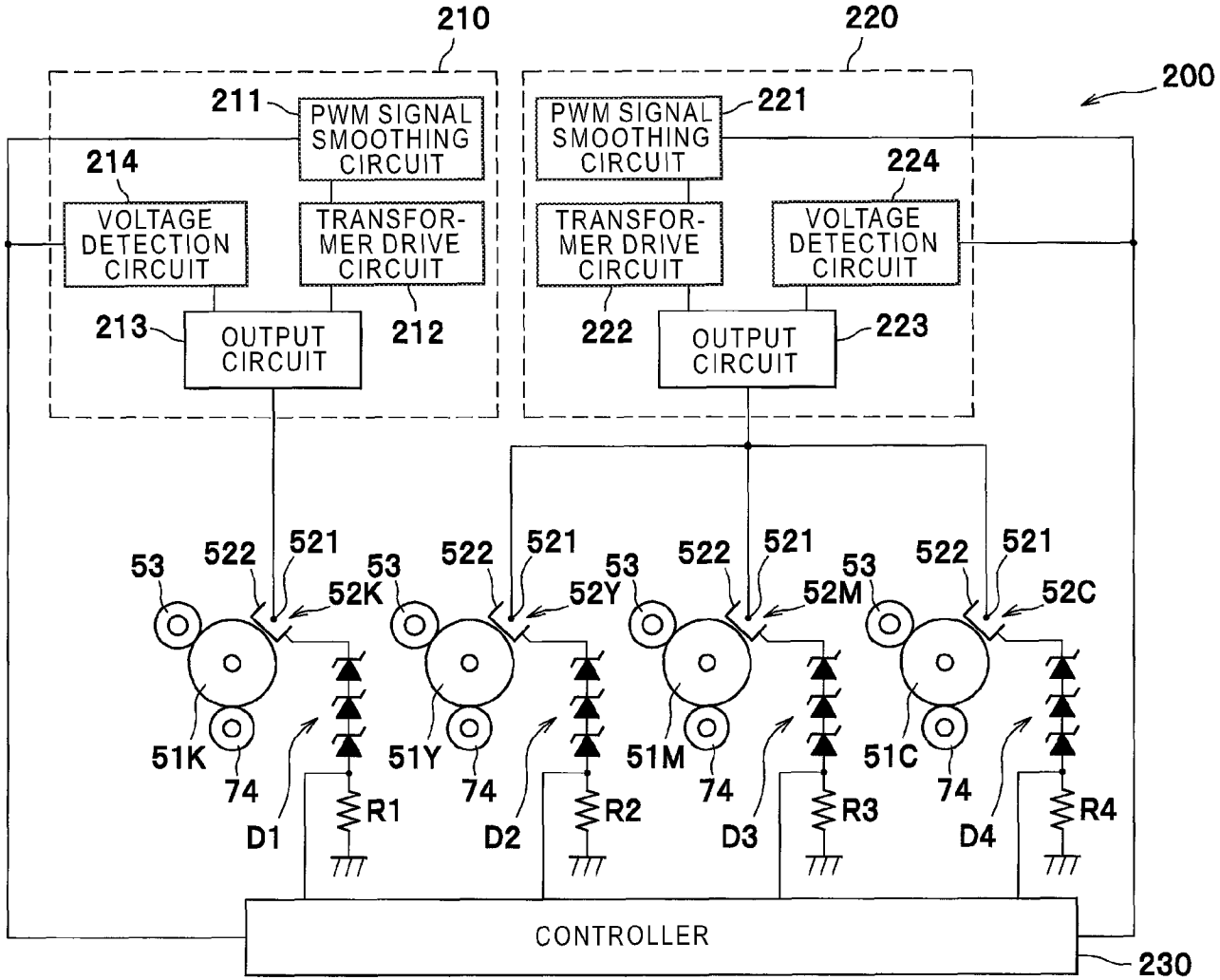
FIG. 2 shows a configuration of a power supply device according to the first exemplary embodiment of the invention.

The scorotron-type charger 52 includes a metal wire 521 and a grid 522 that is arranged between the wire 521 and the photosensitive drum 51 and is formed of a metal plate member (refer to FIG. 2). By applying a voltage from a power supply device 200 (which will be described later) to the scorotron-type charger 52, the scorotron-type charger 52 generates a corona discharge, and ions generated by the corona discharge flow to the photosensitive drum 51 as electric discharge current, so that the photosensitive drum 51 is uniformly charged.

The transfer unit 70 is provided between the feeder unit 20 and the respective developing units 50. The transfer unit 70 includes a driving roller 71, a driven roller 72, a conveyance belt 73 and transfer rollers 74.

The driving roller 71 and the driven roller 72 are arranged in parallel with each other with being spaced in the front-rear direction. The conveyance belt 73 made of an endless belt is stretched between the driving roller 71 and the driven roller 72. An outer surface of the conveyance belt 73 contacts the respective photosensitive drums 51. Also, the four transfer rollers 74 that support the conveyance belt 73 between the respective photosensitive drums 51 and the transfer rollers 74 are arranged to oppose to the respective photosensitive drums 71 at an inner side of the conveyance belt 73. The transfer rollers 74 are applied with transfer biases (bias voltages) having different polarity from charged polarity of the toner by a constant current control when the transfer operation is performed.

The fixing unit 80 is arranged at a rear side of the respective developing units 50 and the transfer unit 70. The fixing unit 80 includes a heating roller 81 and a pressing roller 82 that is opposed to the heating roller 81 and presses the heating roller 81.

In the image forming unit 30 configured as described above, for a color printing mode, the surfaces of the respective photosensitive drums 51 are uniformly charged by the respective scorotron-type chargers 52 and then exposed by the respective LED units 40. According thereto, the potentials of the exposed parts are lowered, so that electrostatic latent images based on image data are formed on the respective photosensitive drums 51. The toner in the toner accommodation chambers 55 are supplied to the developing rollers 53 through the supply rollers 54 and are introduced between the developing rollers 53 and the layer thickness regulation blades 57 so that the toner is carried on the developing rollers 53 as a thin layer having a predetermined thickness.

The toner carried on the developing rollers 53 is supplied to the electrostatic latent images formed on the photosensitive drums 51 from the developing rollers 53. According thereto, the electrostatic latent images become visible, and toner images are formed on the photosensitive drums 51.

As the sheet S fed on the conveyance belt 73 passes between the respective photosensitive drums 51 and the respective transfer rollers 74 arranged on the inner side of the conveyance belt 73, the toner images formed on the respective photosensitive drums 51 are transferred on the sheet S. Then, the sheet S passes between the heating roller 81 and the pressing roller 82, so that the toner images transferred on the sheet S are heated and fixed by the heating roller 81 and the pressing roller 82.

The sheet discharge unit 90 includes a sheet discharge-side conveyance path 91 that extends upwardly from an exit of the fixing unit 80 and is formed to be reversed forwards and a plurality of conveyance rollers 92 that conveys the sheet S. The sheet S, on which the toner images are transferred and are heated and fixed, is conveyed through the sheet discharge-side conveyance path 91 by the conveyance rollers 92, so as to be discharged to the outside of the apparatus body 2. The discharged sheet S is then accumulated on the sheet discharge tray 4.

(Configuration of Power Supply Device)

In the followings, a configuration of the power supply device 200 will be described.

The power supply device 200 is a device for applying voltages to the respective scorotron-type chargers 52. As shown in FIG. 2, the power supply device mainly includes a first voltage applying circuit 210, a second voltage applying circuit 220, a controller 230, constant voltage circuits D1, D2, D3, D4 and current detection units R1, R2, R3, R4.

The first voltage applying circuit 210 and the second voltage applying circuit 220 have PWM signal smoothing circuits 211, 221, transformer drive circuits 212, 222, output circuits 213, 223 and voltage detection circuits 214, 224, respectively.

The first voltage applying circuit 210 is connected to the first scorotron-type charger 52K and applies a voltage to the first scorotron-type charger 52K. The second voltage applying circuit 220 is commonly connected to the second and third scorotron-type chargers 52Y, 52M, 52C and applies a voltage to the second and third scorotron-type chargers 52Y, 52M, 52C.

The PWM signal smoothing circuits 211, 221 smooth PWM signals output from the controller 230 (which will be described later) and output the smoothed PWM signals to the transformer drive circuits 212, 222.

The transformer drive circuits 212, 222 are configured by amplification devices such as transistors, for example. The transformer drive circuits 212, 222 apply voltages corresponding to the PWM signals to the output circuits 213, 223.

The output circuits 213, 223 rectify the voltages input from the transformer drive circuits 212, 222 and output the rectified voltages to the respective scorotron-type chargers 52K, 52Y, 52M, 52C. The wire 521 of the first scorotron-type charger 52K is connected to the output circuit 213 of the first voltage applying circuit 210 and, the wires 521 of the second and third scorotron-type chargers 52Y, 52M, 52C are connected to the output circuit 223 of the second voltage applying circuit 220.

The voltage detection circuits 214, 224 detect voltages occurring in the output circuits 213, 223 and input the detected voltages to the controller 230. According thereto, the controller 230 is able to receive the data of the output voltages of the output circuits 213, 223.

The constant voltage circuits D1, D2, D3, D4 are configured by three zener diodes connected in series, for example, respectively. The consitant voltage circuits D1, D2, D3, D4 make the voltages of the grids 522 of the respective scorotron-type chargers 52K, 52Y, 52M, 52C constant.

The current detection units R1, R2, R3, R4 are configured by resistors, for example. The current detection units R1, R2, R3, R4 are respectively connected to the constant voltage circuits D1, D2, D2, D4. A/D ports (not shown) provided to the controller 230 are respectively connected between the respective current detection units R1, R2, R3, R4 and the respective constant voltage circuits D1, D2, D3, D4 via signal lines. By the above configuration, the voltages proportional to the current values flowing in the respective grids 522 are input to the respective A/D ports. Accordingly, by reading out the voltages input to the respective A/D ports, it is possible to detect the current values of the respective grids.

The controller 230 includes a CPU, a ROM, a RAM and the like. The controller 230 controls the first voltage applying circuit 210 and the second voltage applying circuit 220 in response to programs prepared in advance. Incidentally, the discharge amount flowing on the surface of the photosensitive drum 51 from the scorotron-type charger 52 is substantially proportional to the grid current value flowing in the grid 522. Accordingly, in the first exemplary embodiment, the controller 230 performs the control such that the respective grid current values are a predetermined value or greater in order to prevent the charged amounts on the surfaces of the photosensitive drums 51 from being deficient.

(Control Method by Controller)

Figure 3:
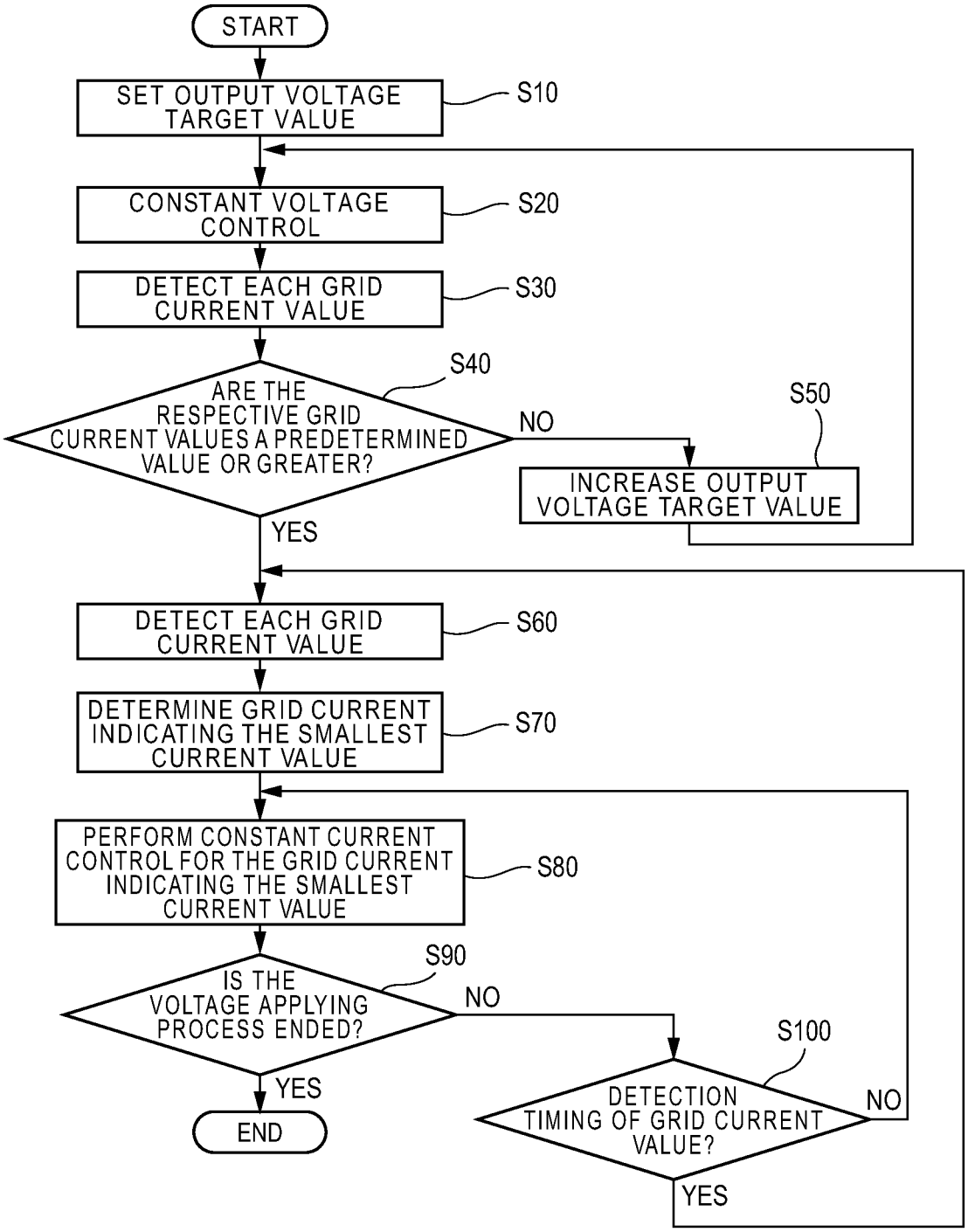
FIG. 3 is a flowchart showing a control of a second voltage applying circuit by the power supply device according to the first exemplary embodiment of the invention.

Next, a control method by the second voltage applying circuit 220 by the controller 230 will be described with reference to FIG. 3. The control of the second voltage applying circuit 220 by the controller 230 includes two-step controls of an initial control (constant voltage control), which is executed just after a printing process is initiated, and an actual control (constant current control), which is executed after the initial control until the printing process ends.

In the initial control, the controller 230 first sets an output voltage of the second voltage applying circuit 220 just after a printing process is initiated, i.e., a target value of a voltage that the second voltage applying circuit 220 applies to the second and third scorotron-type chargers 52Y, 52M, 52C (respective wires 521) (S10).

Then, the controller 230 inputs a PWM signal to the PWM signal smoothing circuit 221 so as to make the output voltage of the second voltage applying circuit 220 become the target value set in step S10. Then, based on a voltage value detected by the voltage detection circuit 224, the controller 230 adjusts the output voltage of the second voltage applying circuit 220 so as to stabilize the output voltage of the second voltage applying circuit 220 at the target value (S20).

When the output voltage is stabilized in step S20, the controller 230 calculates (detects) grid current values flowing in the respective current detection units R2, R3, R4, i.e., grid current values flowing in the respective grids 522, from the voltages input to the respective A/D ports (S30). Then, the controller 230 determines whether all the respective grid current values detected in step S30 are a predetermined value or greater (S40).

When it is determined in step S40 that even one grid current value is smaller than the predetermined value (S40, No), the controller 230 increase the target value of the output voltage (S50). After that, the processes of S20 to S40 are repeated until all the grid current values become the predetermined value or greater.

When it is determined in step S40 that the respective grid current values are the predetermined value or greater (S40, Yes), the control by the controller 230 is shifted to the actual control.

In the actual control, the controller 230 first detects the grid current values flowing in the respective grids 522 (S60). Then, the controller 230 determines a grid current indicating the smallest current value of the respective grid current values detected in step S60 (S70).

Then, the controller 230 controls the second voltage applying circuit 220 so that the grid current indicating the smallest current value, which is determined in step S70, becomes a constant current having a predetermined value or greater (S80). Specifically, in step S80, the controller 230 outputs the PWM signal to the PWM signal smoothing circuit 221, based on the voltage input to the A/D port corresponding to the grid 522 indicating the smallest current value, so as to adjust the output voltage such that the grid current indicating the smallest current value becomes the constant current. Accordingly, by constant current-controlling the grid current indicating the smallest current value, it is also possible to maintain the other grid current values at the current value having a predetermined value or greater.

Then, the controller 230 determines whether or not to end the voltage applying process (S90). When continuing to perform the voltage applying process (S90, No), the controller 230 determines whether it is a timing for detecting the grid current values (S100). Specifically, the controller 230 detects the respective grid current values every predetermined number of printed sheets. When the number of printed sheets reaches a predetermined number (S100, Yes), the controller 230 detects the respective grid current values (S60) and again determines the grid current indicating the smallest current value (S70). On the other hand, when it is determined in step S100 that the number of printed sheets does not reach a predetermined value (S 100, No), the controller 230 continues to perform the constant current control (S80).

When the printing process by the image forming apparatus 1 ends, the controller 230 determines in step S90 to end the voltage applying process (S90, Yes), and the control of the second voltage applying circuit 220 by the controller 230 ends.

Incidentally, regarding the first voltage applying circuit 210, the controller 230 executes the above initial control and then performs the constant current control so that the grid current value of the first scorotron-type charger 52K becomes a predetermined value or greater.

As described above, following operational effects can be realized by the above-described first exemplary embodiment.

The first exemplary embodiment provides the first voltage applying circuit 210, which is connected to the first scorotron-type charger 52K corresponding to the black toner having high using frequency, and the second voltage applying circuit 220, which is commonly connected to the second and third scorotron-type chargers 52Y, 52M, 52C corresponding to the respective colors except for black. Accordingly, it is possible to reduce the difference of the discharge amounts of the first scorotron-type charger 52K and the second and third scorotron-type chargers 52Y, 52M, 52C, which is caused due to the difference of contamination degrees of the wires 521.

The first exemplary embodiment provides the current detection units R2, R3, R4, which detect the grid current values flowing in the respective grids 522, and the controller 230, which controls the second voltage applying circuit 220 to make the respective grid current values become a predetermined value or greater. Accordingly, it is possible to sufficiently charge the surfaces of the corresponding second and third photosensitive drums 51Y, 51M, 51C.

In addition, the controller 230 determines the grid current value indicating the smallest current value of the grid current and controls the second voltage applying circuit 220 to make the grid current indicating the smallest current value become the constant current having a predetermined value or greater. Accordingly, by performing constant current control of the one grid current, it is possible to maintain the other grid current values at the current value of a predetermined value or greater.

Also, the controller 230 determines the grid current indicating the smallest current value every predetermined number of printed sheets. Accordingly, even when the scorotron-type charger indicating the smallest current value is changed during the printing operation, it is possible to perform the constant current control in accordance with the grid current value of the scorotron-type charger indicating the smallest current value after the change.

In the above-described first exemplary embodiment, in step S100, the grid current indicating the smallest current value is determined every predetermined number of printed sheets. However, the invention is not limited thereto. For example, the grid current indicating the smallest current value may be determined every predetermined time period. Even when the grid current indicating the smallest current value is determined every predetermined time period, it is possible to cope with the change in the order of magnitudes of the grid current values during the printing operation.

Figure 4:
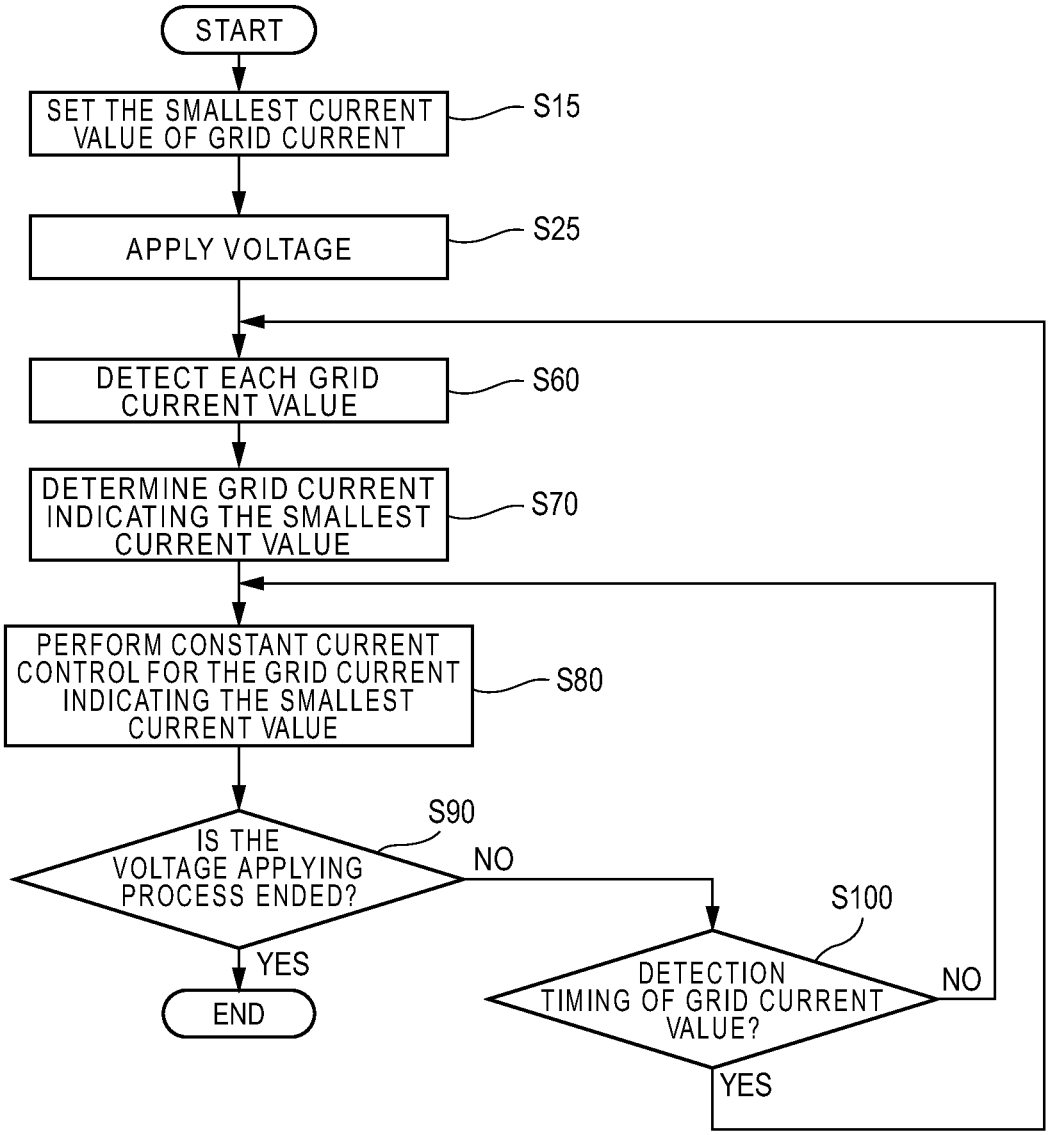
FIG. 4 is a flowchart showing a control of a second voltage applying circuit by a power supply device according to a modified embodiment.

In the above-described first exemplary embodiment, in the initial control, while performing the constant current control, the voltage is controlled to make the respective grid current values become a predetermined value or greater. However, the invention is not limited thereto. For example, as shown in FIG. 4, the initial control may be simplified.

Specifically, the controller 230 first sets the smallest value (i.e., target current value) of the respective grid current values as the printing operation is initiated (S15).

Then, the controller 230 controls the second voltage applying circuit 220 so as to make the respective grid current values become the set current value. The second voltage applying circuit 220 applies the voltage to the respective scorotron-type chargers 52C, 52Y, 52M (S25). Then, after step S25, the controller proceeds to the actual control (since step S60).

Accordingly, by simplifying the initial control, it is possible to end the initial control in a short time.

Second Exemplary Embodiment

In the followings, a second exemplary embodiment of the invention will be specifically described with reference to the drawings. In this second exemplary embodiment, the control method by the controller 230 of the power supply device 200 having the same configuration as the first exemplary embodiment is simplified. In this second exemplary embodiment, the same components as the first exemplary embodiment are indicated by the same reference numerals and the descriptions thereof are omitted.

In the second exemplary embodiment, regarding the control by the controller 230, the process of step S10 to S40 is the same as the first exemplary embodiment. In the process since step S40, the control of maintaining the respective grid current values at a predetermined value or greater is performed without determining the grid current indicating the smallest current value.

Figure 5:
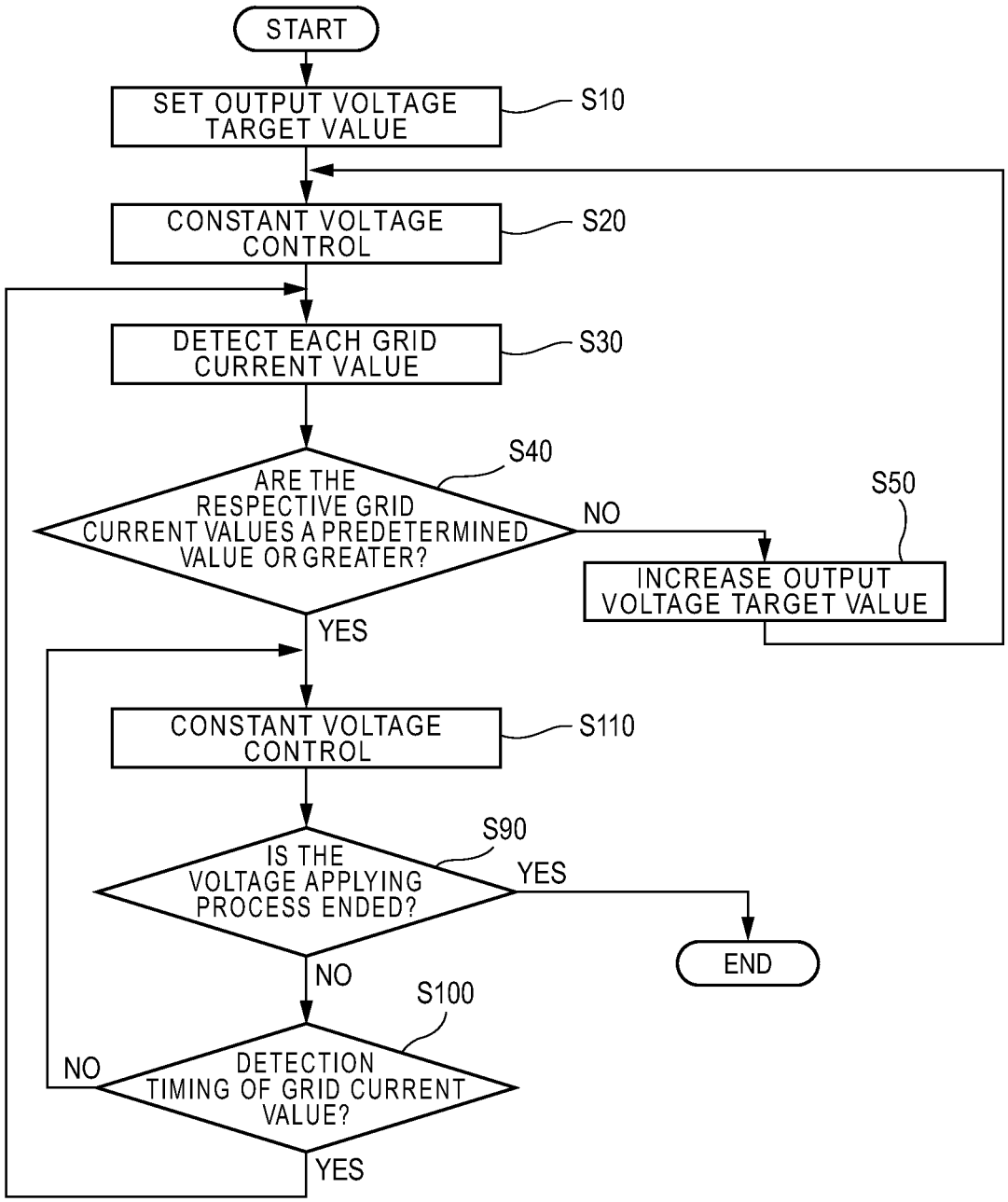
FIG. 5 is a flowchart showing a control of a second voltage applying circuit by a power supply device according to a second exemplary embodiment.

Specifically, as shown in FIG. 5, in step S40, when all the respective grid current values are a predetermined value or greater (S40, Yes), the controller 230 performs the constant voltage control (S110). Then, the controller 230 determines whether or not to end the voltage applying process (S90). When the controller 230 determines to end the voltage applying process (S90, Yes), the control by the controller 230 ends.

In step S90, when the controller 230 determines not to end the voltage applying process (S90, No), the controller 230 determines whether it is a timing for detecting the grid current values (S100). When it is a timing for detecting the grid current values (S100, Yes), the controller 230 detects the respective grid current values (S30) and determines whether all the detected respective grid current values are a predetermined value or greater (S40). When one of the respective grid current values is smaller than the predetermined value (S40, No), the controller 230 controls the second voltage applying circuit 220 so as to increase the voltage to be applied between the wires 521 and the grids 522 of the second and third scorotron-type chargers 52Y, 52M, 52C (S50). On the other hand, when it is not a timing for detecting the grid currents (S100, No), the controller 230 continues to perform the constant voltage control (S110).

According to the above-described second exemplary embodiment, since the step of determining the grid current indicating the smallest current value is omitted, it is possible to simplify the control, compared to the first exemplary embodiment.

Third Exemplary Embodiment

In the followings, a third exemplary embodiment of the invention will be specifically described with reference to the drawings. In the third exemplary embodiment, the same components as the first exemplary embodiment are indicated by the same reference numerals and the descriptions thereof are omitted.

Figure 6:
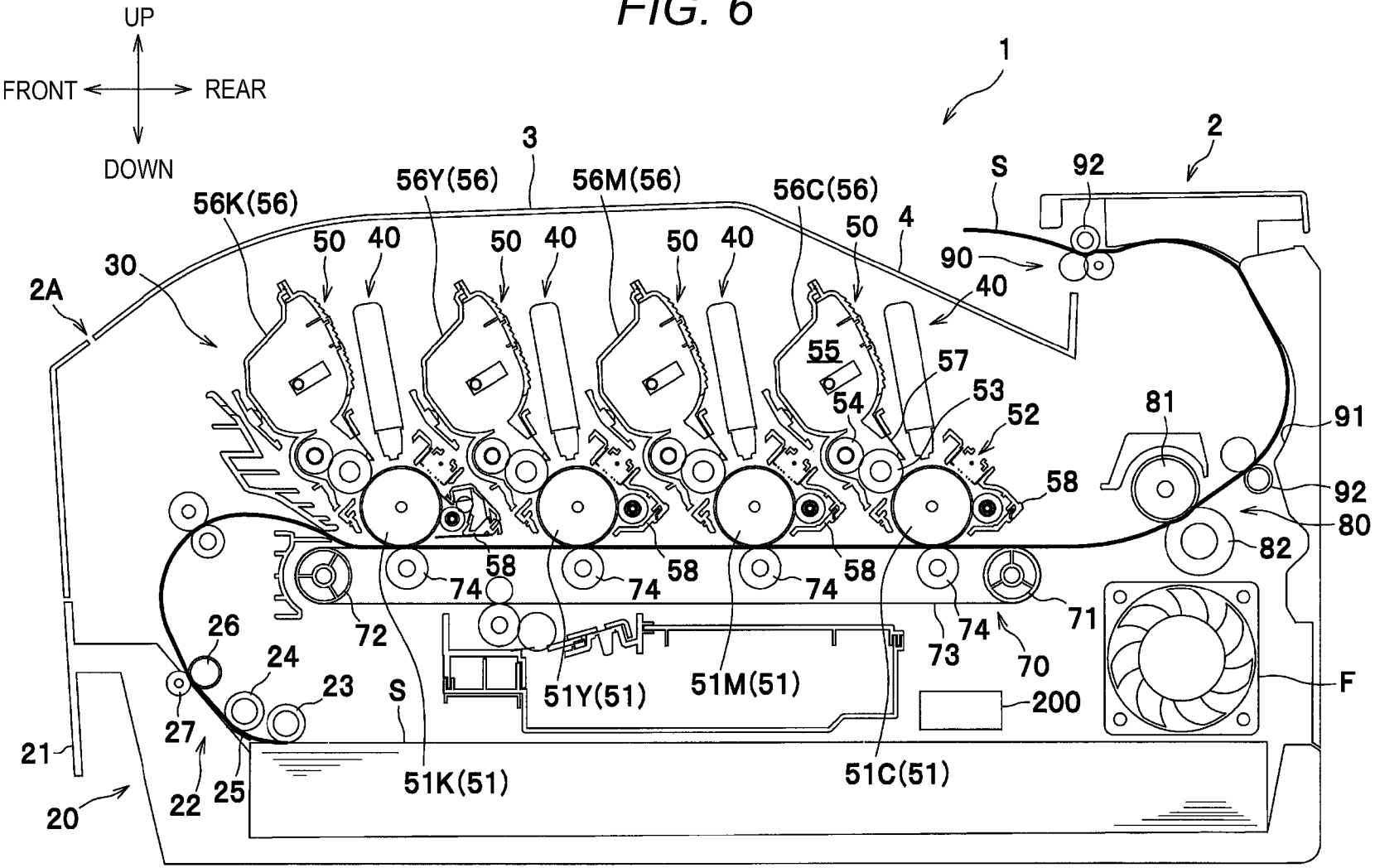
FIG. 6 is a side sectional view showing an image forming apparatus according to a third exemplary embodiment of the invention.

In the third exemplary embodiment, as shown in FIG. 6, regarding the image forming apparatus 1, a fan F for exhausting the air in the apparatus body 2 is provided to the rear (the more rearward side than the developing cartridge 56C for cyan) of the left sidewall of the apparatus body 2.

In the third exemplary embodiment, the photosensitive drum 51C for cyan is referred to as 'first photosensitive drum 51C' (first photosensitive member). Also, the photosensitive drums 51K, 51Y, 51M except for cyan, which are arranged in parallel with each other at positions more distant from the fan F than the first photosensitive drum 51C, are referred to as 'second and third photosensitive drums 51K, 51Y, 51M' (second and third photosensitive members). In addition, the scorotron-type charger 52C for cyan, which charges the first photosensitive drum 51C, is referred to as 'first scorotron-type charger 52C', and the scorotron-type chargers 52K, 52Y, 52M except for cyan, which charge the photosensitive drums 51K, 51Y, 51M, are referred to as 'second and third scorotron-type chargers 52K, 52Y, 52M.'

Figure 7:
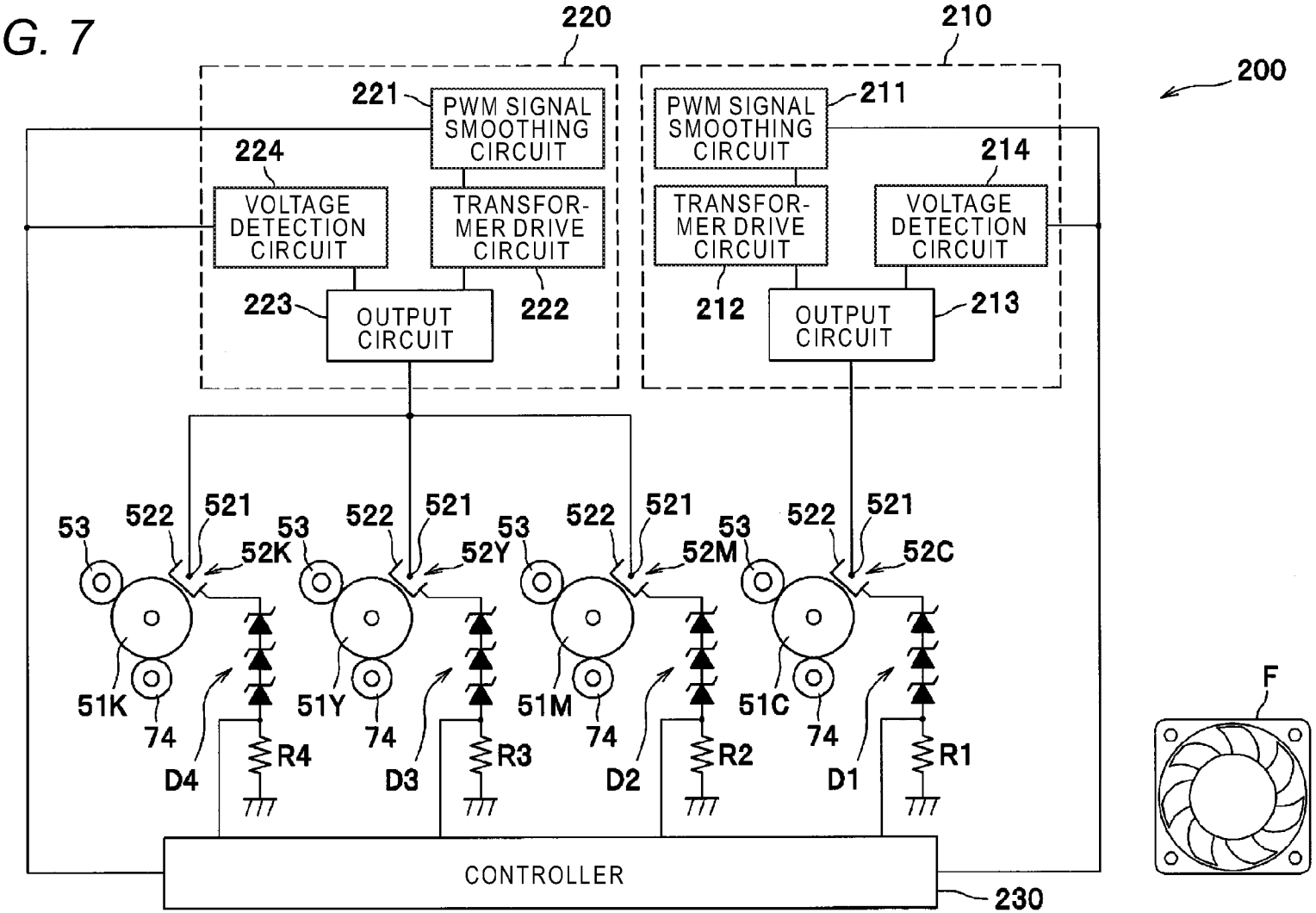
FIG. 7 shows a configuration of a power supply device according to the third exemplary embodiment of the invention

As shown in FIG. 7, the power supply device 200 of the third exemplary embodiment mainly includes a first voltage applying circuit 210, a second voltage applying circuit 220, a controller 230, constant voltage circuits D1, D2, D3, D4 and current detection units R1, R2, R3, R4.

In the third exemplary embodiment, the first voltage applying circuit 210 is connected to the first scorotron-type charger 52C and applies a voltage to the first scorotron-type charger 52C. The second voltage applying circuit 220 is commonly connected to the second and third scorotron-type chargers 52K, 52Y, 52M and applies a voltage to the second and third scorotron-type chargers 52K, 52Y, 52M.

Also, in the third exemplary embodiment, the output circuits 213, 223 rectify the voltages input from the transformer drive circuits 212, 222 and output the rectified voltages to the respective scorotron-type chargers 52K, 52Y, 52M, 52C. The wire 521 of the first scorotron-type charger 52C is connected to the output circuit 213 of the first voltage applying circuit 210, and the wires 521 of the second and third scorotron-type chargers 52K, 52Y, 52M are connected to the output circuit 223 of the second voltage applying circuit 220.

Incidentally, since the other configurations of the power supply device 200 are the same as the first exemplary embodiment, the descriptions thereof are omitted.

In the followings, a control method of the second voltage applying circuit 220 by the controller 230 according to the third exemplary embodiment will be described with reference to FIG. 3.

Like the first exemplary embodiment, the control of the second voltage applying circuit 220 by the controller 230 includes two-step controls of an initial control (constant voltage control), which is executed just after a printing process is initiated, and an actual control (constant current control), which is executed after the initial control until the printing process ends.

In the third exemplary embodiment, in the initial control, the controller 230 sets an output voltage of the second voltage applying circuit 220 just after a printing process is initiated, i.e., a target value of a voltage that the second voltage applying circuit 220 applies to the second and third scorotron-type chargers 52K, 52Y, 52M (respective wires 521) (S10).

Then, the controller 230 inputs a PWM signal to the PWM signal smoothing circuit 221 so as to make the output voltage of the second voltage applying circuit 220 become the target value set in step S10. Then, based on a voltage value detected by the voltage detection circuit 224, the controller 230 adjusts the output voltage of the second voltage applying circuit 220 so as to stabilize the output voltage of the second voltage applying circuit 220 at the target value (S20).

When the output voltage is stabilized in step S20, the controller 230 calculates (detects) grid current values flowing in the respective current detection units R2, R3, R4, i.e., grid current values flowing in the respective grids 522, from the voltages input to the respective A/D ports (S30). Then, the controller 230 determines whether all the respective grid current values detected in step S30 are a predetermined value or greater (S40).

When it is determined in step S40 that even one grid current value is smaller than the predetermined value (S40, No), the controller 230 increase the target value of the output voltage (S50). After that, the processes of S20 to S40 are repeated until all the grid current values become the predetermined value or greater.

When it is determined in step S40 that the respective grid current values are the predetermined value or greater (S40, Yes), the control by the controller 230 is shifted to the actual control.

Since the control of the second voltage applying circuit 220 by the controller 230 in steps S60 to S100 is the same as the first exemplary embodiment, the descriptions thereof are omitted.

Incidentally, in the third exemplary embodiment, after performing the above initial control for the first voltage applying circuit 210, the controller 230 performs the constant current control so as to make the grid current value of the first scorotron-type charger 52C become a predetermined value or greater.

According to the above configuration, in the third exemplary embodiment, following operational effects can be realized in addition to those of the first exemplary embodiment.

The third exemplary embodiment provides the first voltage applying circuit 210, which is connected to the first scorotron-type charger 52C, and the second voltage applying circuit 220, which is commonly connected to the second and third scorotron-type chargers 52K, 52Y, 52M arranged at the positions more distant from the fan F than the first scorotron-type charger 53C. Accordingly, it is possible to reduce the difference of the discharge amounts of the first scorotron-type charger 52C and the second and third scorotron-type chargers 52K, 52Y, 52M, which is caused due to the difference of contamination degrees of the wires 521.

The third exemplary embodiment provides the current detection units R2, R3, R4, which detect the grid current values flowing in the respective grids 522, and the controller 230, which controls the second voltage applying circuit 220 so that the respective grid current values become a predetermined value or greater. Accordingly, it is possible to sufficiently charge the surfaces of the corresponding second and third photosensitive drums 51K, 51Y, 51M.

In addition, the controller 230 determines the grid current indicating the smallest current value of the grid current values and controls the second voltage applying circuit 220 to make the grid current indicating the smallest current value become the constant current having a predetermined value or greater. Accordingly, by performing constant current control of the one grid current, it is possible to maintain the other grid current values at the current value of a predetermined value or greater.

Also, the controller 230 determines the grid current indicating the smallest current value every predetermined number of printed sheets. Accordingly, even when the scorotron-type charger indicating the smallest current value is changed during the printing operation, it is possible to perform the constant current control in accordance with the grid current of the scorotron-type charger indicating the smallest current value after the change.

Incidentally, the invention is not limited to the third exemplary embodiment. For example, as shown in FIG. 4, the initial control may be simplified.

Specifically, the controller 230 sets the smallest value (i.e., target current value) of the respective grid current values as the printing operation is initiated (S15).

Then, the controller 230 controls the second voltage applying circuit 220 so as to make the respective grid current values become the set current value. The second voltage applying circuit 220 applies the voltage to the respective scorotron-type chargers 52K, 52Y, 52M (S25). Then, after step S25, the controller proceeds to the actual control (since step S60).

According thereto, by simplifying the initial control, it is possible to end the initial control in a short time.

In the third exemplary embodiment, the scorotron-type charger 52C for cyan is connected to the first voltage applying circuit 210, and the scorotron-type chargers 52K, 52Y, 52M for black, yellow and magenta are connected to the second voltage applying circuit 220. However, the invention is not limited thereto. For example, the developing cartridge 56K for black may be arranged at a position close to the fan F and may be solely connected to the first voltage applying circuit 210. By such configuration, it is possible to solely control the voltage of the scorotron-type charger 52K for black, which is frequently used and is thus apt to be contaminated.

Fourth Exemplary Embodiment

In the followings, a fourth exemplary embodiment of the invention will be specifically described with reference to the drawings.

In this fourth exemplary embodiment, the control method by the controller 230 of the power supply device 200 having the same configuration as the third exemplary embodiment is simplified. In this fourth exemplary embodiment, the same components as the third exemplary embodiment are indicated by the same reference numerals and the descriptions thereof are omitted.

In the fourth exemplary embodiment, regarding the control by the controller 230, the process of step S10 to S40 is the same as the third exemplary embodiment. In the process since step S40, the control of maintaining the respective grid current values at a predetermined value or greater is performed without determining the grid current indicating the smallest current value.

Specifically, as shown in FIG. 5, in step S40, when all the respective grid current values are a predetermined value or greater (S40, Yes), the controller 230 performs the constant voltage control (S110).

Then, the controller 230 determines whether or not to end the voltage applying process (S90). When the controller 230 determines to end the voltage applying process (S90, Yes), the control by the controller 230 ends.

In step S90, when the controller 230 determines not to end the voltage applying process (S90, No), the controller 230 determines whether it is a timing for detecting the grid current values (S100). When it is a timing for detecting the grid current values (S100, Yes), the controller 230 detects the respective grid current values (S30) and determines whether all the detected respective grid current values are a predetermined value or greater (S40). When one of the respective grid current values is smaller than the predetermined value (S40, No), the controller 230 controls the second voltage applying circuit 220 so as to increase the voltage to be applied between the wires 521 and the grids 522 of the second and third scorotron-type chargers 52K, 52Y, 52M (S50). On the other hand, when it is not a timing for detecting the grid currents (S100, No), the controller 230 continues to perform the constant voltage control (S110).

According to the above-described fourth exemplary embodiment, since the step of determining the grid current indicating the smallest current value is omitted, it is possible to simplify the control, compared to the third exemplary embodiment.

Although the exemplary embodiments of the invention have been described, the invention is not limited to the above-described exemplary embodiments. That is, the specific configurations can be appropriately changed without departing from the gist of the invention.

In the above-described exemplary embodiments, the color printer has been exemplified as the image forming apparatus. Alternatively, the image forming apparatus may be a complex machine or a copier.

What is claimed is:

1. An image forming apparatus comprising:

a first photosensitive member;

a second photosensitive member;

a third photosensitive member;

a first scorotron-type charger that is configured to charge the first photosensitive member;

a second scorotron-type charger that is configured to charge the second photosensitive member;

a third scorotron-type charger that is configured to charge the third photosensitive member;

a first voltage applying circuit, which is connected to the first scorotron-type charger, and which is configured to apply a voltage to the first scorotron-type charger; and a second voltage applying circuit, which is commonly connected to the second scorotron-type charger and the third scorotron-type charger, and which is configured to apply a voltage to the second scorotron-type charger and the third scorotron-type charger, wherein the first scorotron-type charger, the second scorotron-type charger and the third scorotron-type charger comprises a wire and a grid, respectively, wherein the image forming apparatus further comprises:

a current detection unit that is configured to detect grid current values flowing in the grids of the second scorotron-type charger and the third scorotron-type charger; and a controller that is configured to control the second voltage applying circuit so as to make the respective grid current values become a predetermined value or greater, and wherein the controller is further configured to:

determine a grid current indicating the smallest current value of the respective grid current values; and control the second voltage applying circuit so as to make the grid current indicating the smallest current value become a constant current of the predetermined value or greater.

2. The image forming apparatus according to claim 1, wherein the controller is further configured to determine the grid current indicating the smallest current value every predetermined number of printed sheets.

3. The image forming apparatus according to claim 1, wherein the controller is further configured to determine the grid current indicating the smallest current value every predetermined time period.

4. The image forming apparatus according to claim 1, wherein when at least one of the respective grid current values is smaller than a predetermined value, the controller is configured to control the second voltage applying circuit so as to increase the voltage to be applied to the second scorotron-type charger and the third scorotron-type charger.

5. The image forming apparatus according to claim 4, wherein the controller is further configured to detect the respective grid current values every predetermined number of printed sheets.

6. The image forming apparatus according to claim 4, wherein the controller is further configured to detect the respective grid current values every predetermined time period.

7. The image forming apparatus according to claim 1, wherein the first photosensitive member corresponds to black developer, and wherein the second photosensitive member and the third photosensitive member correspond to developers other than black.

8. The image forming apparatus according to claim 1, further comprising a fan that is configured to exhaust air in the image forming apparatus to an outside, wherein the first photosensitive member is arranged more closely to the fan than the second photosensitive member and the third photosensitive member.

* * * * *